US009857047B2

(12) United States Patent
Heine et al.

(10) Patent No.: US 9,857,047 B2
(45) Date of Patent: Jan. 2, 2018

(54) COOLING MEMBER AND MOTOR VEHICLE LIGHTING OR SIGNALING DEVICE COMPRISING SUCH A MEMBER

(71) Applicant: Valeo Vision, Bobigny (FR)

(72) Inventors: Jean-Baptiste Heine, Le Kremlin Bicetre (FR); Christine Roucoules, Deuil la Barre (FR)

(73) Assignee: VALEO VISION, Bobigny (FR)

( * ) Notice: Subject to any disclaimer, the term of this patent is extended or adjusted under 35 U.S.C. 154(b) by 93 days.

(21) Appl. No.: 14/781,810

(22) PCT Filed: Apr. 18, 2014

(86) PCT No.: PCT/EP2014/058011
§ 371 (c)(1),
(2) Date: Oct. 1, 2015

(87) PCT Pub. No.: WO2014/170484
PCT Pub. Date: Oct. 23, 2014

(65) Prior Publication Data

US 2016/0040853 A1 Feb. 11, 2016

(30) Foreign Application Priority Data

Apr. 19, 2013 (FR) ..... 13 53628

(51) Int. Cl.
*F21V 1/00* (2006.01)
*F21S 8/10* (2006.01)
(Continued)

(52) U.S. Cl.
CPC ..... *F21S 48/328* (2013.01); *F21S 48/115* (2013.01); *F21S 48/1154* (2013.01);
(Continued)

(58) Field of Classification Search
CPC .... F21S 48/328; F21S 48/115; F21S 48/1154; F21S 48/215; F21S 48/321;
(Continued)

(56) References Cited

U.S. PATENT DOCUMENTS 8,118,462 B2 2/2012 Inoue et al.
8,430,523 B1 * 4/2013 Smith ..... F21V 29/004 362/235
2006/0250800 A1 * 11/2006 Chang ..... F21K 9/00 362/294
2008/0158876 A1 7/2008 Thrailkill
2009/0154180 A1 * 6/2009 Cho ..... F21S 48/1159 362/459
(Continued)

FOREIGN PATENT DOCUMENTS

EP 2138759 A1 12/2009
EP 2187121 A1 5/2010
(Continued)

*Primary Examiner* — Alexander Garlen
(74) *Attorney, Agent, or Firm* — Oblon, McClelland, Maier & Neustadt, L.L.P.

(57) ABSTRACT

A cooling member for a lighting and/or signaling device for a motor vehicle, the member comprising a base configured to support a light source of the device, and at least one heat dissipating device in thermal conduction connection with the base, the heat dissipating device comprising a plurality of heat dissipation fins, the base having large faces linked by a wafer, each of the fins extending from one of the large faces, the base extending in shape such that junction areas of at least two of the fins with the base extend in different planes.

20 Claims, 2 Drawing Sheets

(51) Int. Cl.
*F21V 29/76* (2015.01)
*F21V 29/74* (2015.01)

(52) U.S. Cl.
CPC ..... *F21S 48/215* (2013.01); *F21S 48/321* (2013.01); *F21V 29/74* (2015.01); *F21V 29/76* (2015.01); *F21V 29/763* (2015.01); *F21V 29/767* (2015.01)

(58) Field of Classification Search
CPC .... F21V 29/2212; F21V 29/74; F21V 29/763; F21V 29/767; F21V 29/773; F21V 29/77; F21V 29/777; F21V 29/76763
See application file for complete search history.

(56) References Cited

U.S. PATENT DOCUMENTS

| | | | | |
|---|---|---|---|---|
| 2009/0302345 | A1* | 12/2009 | Chuang | H01L 33/641 257/99 |
| 2009/0316425 | A1 | 12/2009 | Inoue et al. | |
| 2010/0118496 | A1* | 5/2010 | Lo | F21V 15/013 361/710 |
| 2012/0162974 | A1* | 6/2012 | Yu | F21V 15/013 362/218 |
| 2013/0135888 | A1* | 5/2013 | Le Bars | F21S 48/1104 362/517 |

FOREIGN PATENT DOCUMENTS

| | | | |
|---|---|---|---|
| JP | 2007109613 | A | 4/2007 |
| JP | 2008047385 | A | 2/2008 |

* cited by examiner

COOLING MEMBER AND MOTOR VEHICLE LIGHTING OR SIGNALING DEVICE COMPRISING SUCH A MEMBER

CROSS-REFERENCE TO RELATED APPLICATIONS

This application is the U.S. National Phase application of PCT Application No. PCT/EP2014/058011 filed Apr. 18, 2014, which claims priority to the French application 1353628 filed on Apr. 19, 2013, which applications are incorporated herein by reference and made a part hereof.

BACKGROUND OF THE INVENTION

1. Field of the Invention

The invention relates to a cooling member and a lighting or signaling device for a motor vehicle comprising such a member.

2. Description of the Related Art

Motor vehicle lighting or signaling devices are composed by and large of a housing that is closed by a transparent wall, through which one or a plurality of light beams emerge. This housing accommodates at least one optical module, largely comprising a light source, and an optical system capable of modifying at least one parameter of the light generated by the light source for the emission of the light beam by the optical module. The optical system comprises optical components such as a reflector, a lens, a diffusing element or a collimator, or any other member capable of modifying at least one of the parameters of the light generated by the light source.

Developments in technology tend to favor the use of light sources constituted by at least one LED (Light Emitting Diode), because of their low energy consumption and the quality of the lighting obtained. LEDs do not radiate in an omnidirectional manner, but in a more directional manner than other light sources. The compact dimensions of the LEDs and their directional light radiation permit the dimensions to be reduced and the structure of the optical module to be simplified, with the advantage of facilitating its integration in the interior of the housing. In the course of their operation, however, LEDs produce heat which is detrimental to their performance, since the greater the rise in the temperature of an LED, the greater is the reduction in its luminous flux. The heat that is released may even give rise to problems relating to the adequate supply of electrical power to the LEDs. It is therefore necessary to make provisions in order to permit cooling of the one or more LEDs which constitute the light source of the optical module, so as to prevent an increase in the temperature of the LEDs beyond an acceptable operating threshold.

For this purpose, it is customary to equip the optical module with a finned heat dissipater. The heat generated by the light source is evacuated in this way towards the internal volume of the housing and/or towards the exterior of the housing, on the basis of a thermal exchange utilizing the surface area of the fins that make up the dissipater. The optimization of the thermal exchange, between the finned dissipater heated by the LED and the air, may be achieved by the enlargement of the surface area via an increase in the size and/or the number of fins of the cooling member. However, this solution is implemented by increasing the size of a flat supporting base. This has the disadvantage of resulting in the enlargement of the surface dimensions of the optical module, which must be avoided in order to facilitate its implantation in the interior of the housing. In addition, such implantation is likely to be difficult in view of the restricted nature of the space available to accommodate the one or more optical modules, and/or in view of the constraints associated with the general arrangement of the lamp unit in respect of its immediate environment when it is mounted on the vehicle. It is consequently appropriate to organize the cooling of the one or more optical modules in such a way as not to obstruct their implantation in the interior of the housing.

It is also necessary to take account of the fact that the volume of the means used for the cooling of the LEDs that are contained in the optical modules is dependent on the quantity of heat that they generate at their operating power, this in turn being dependent on the luminous intensity that is necessary for the emission of light by the corresponding light beam. The volume of the lighting devices may sometimes be large, however, and it is important to restrict their dimensions.

Furthermore, it is important to identify solutions which permit the exchange surface to be increased without compromising their reliability, in particular mechanically, and which are cost-effective.

SUMMARY OF THE INVENTION

The aim of the present invention is to propose a cooling member for a lighting and/or signaling device for a motor vehicle which respects the aforementioned constraints.

Proposed according to the present invention is a cooling member for a lighting and/or signaling device for a motor vehicle, the member comprising a base that is configured to support a light source of the device, and at least one heat dissipating device in thermal conduction connection with the base, the heat dissipating device comprising a plurality of heat dissipation fins, the base having large faces linked by a wafer, each of the fins extending from one of the large faces, the base extending in shape such that junction areas of at least two of the fins with the base extend in different planes.

The expression fins is used to denote elements having a thickness that is much smaller than their other dimensions. These are, for example, flat elements, having two mutually parallel plane faces. In other words, each of the fins has a junction area with the base extending linearly, in particular in a straight line, on one of the large faces.

By providing an extension in the form of the base, the dimensions of the cooling member are distributed inside the space. It is possible in this way to make available a larger exchange surface, by limiting the enlargement of the size of the member in a single plane. Using fins extending from one and only one of the large faces in addition makes it possible to avoid the use of fins of complex shape while allowing the establishment of an effective thermal connection with the base, according to low-cost and mechanically reliable techniques, in particular in respect of the resistance to vibrations. These may include, among others:

- fins extruded with the base;
- fins attached individually to the base, along their wafer;
- fins matched in pairs of fins obtained from the "U"-shaped folding of a sheet of material; this pair of fins may be joined to the base in the area of the section joining the two branches of the "U", in particular in such a way as to permit their attachment to the base on a larger contact surface than on a wafer of a fin and accordingly a more secure attachment; as a variant, this pair of fins may be joined to the base in the area of the extremities of the two branches of the "U", thus permitting the exchange surface to be increased, since the section joining the two branches of the "U" is then at a distance from the base;

fins obtained from the folding like an accordion of a sheet of material; this makes it possible in particular to combine the advantages of the two variants of the pairs of "U"-shaped fins, due to the presence both of junctions to the base in the area of the sections joining the fins, in particular in such a way as to permit attachments to the base on contact surfaces that are larger than on fin wafers and therefore a more secure attachment, and of an increase in the exchange surface thanks to the sections joining the fins at a distance from the base.

According to different modes of implementation of the invention, which may be considered together or separately:

the material of the fins is a deformable metal, for example aluminum or an alloy of aluminum;

the fins are attached to the base by welding, gluing and/or brazing;

the large faces of the base are ruled surfaces, in particular plane surfaces;

the base comprises a floor and at least one lateral fin;

the one or more lateral fins extend from the floor;

the floor is configured to support the light source;

the floor and/or the one or more lateral fins are flat and each comprise two of the large faces;

a first plurality of the fins extends from the floor, and/or a second plurality of the fins extends from the lateral fin;

one at least of the pluralities of fins is extruded and/or molded with the base, as already discussed above;

one at least of the pluralities of fins is attached to the base;

the fins of the one or more the pluralities of fins attached to the base are secured individually to the base;

grooves are provided in the base to receive the fins;

at least certain of the fins of the one or more the pluralities of fins attached to the base are secured in pairs to the base in the form of a folded sheet, as already discussed above;

at least certain of the fins of the one or of the pluralities of fins attached to the base are secured to the base in the form of a sheet folded like an accordion, as already discussed above;

the sheet is folded continuously as a series of adjacent air convection channels;

the thickness of the fins is between 0.8 and 1 millimeter, in particular for the fins of the one or more series of fins attached to the base;

the distance between the fins is between 4 and 6 millimeters in particular for the fins of the one or more series of fins attached to the base;

the fins are configured in such a way as to permit the convection of the air between them, which offers the advantage of not having to resort to forced circulation of the air.

The invention also relates to a lighting and/or signaling device for a motor vehicle comprising a cooling member as described previously.

The lighting and/or signaling device comprises, in particular, a housing that is closed by an outer lens intended to be traversed by one or a plurality of light beams, the housing accommodating at least one optical module comprising the light source and an optical system that is capable of modifying at least one parameter of the light generated by the light source for the emission of the one or more light beams by the lighting device, the heat dissipating device being mounted in the available volume of the housing around the optical module and/or the optical system.

In other words, the heat dissipating device is adapted to the optical module and/or to the optical system so as to be capable of being mounted in the available volume of the housing around the members without impeding the operation of the latter.

The result of this provision is an enlargement of the heat exchange surface associated with the lighting and/or signaling device without having to increase its dimensions. This enlargement of the heat exchange surface makes it possible to optimize the cooling of the optical module and to adapt this cooling to a more powerful light source in case of need.

The lighting and/or signaling device may include one or more optical modules, of which the light sources have an operating power capable of emitting a light beam of moderate to strong intensity. Advantageously, the light source includes LEDs, or electroluminescent diodes, and the heat generated by them must be removed. The LEDs may, for example, emit a powerful lighting beam, for example of the low beam and/or high beam type, or they may also emit a moderate lighting beam for the emission of a daytime position light or signaling light. The powerful LEDs are LEDs generally having a luminous flux in the order of at least 30 lumens and releasing a greater heat than LEDs with a moderate luminous flux intended for signaling.

The fins are configured in particular in order not to impede an ascending convection air flow.

The heat exchange surface or the plane of the fins of the heat dissipating device is more specifically oriented in the general axis of gravity. This heat exchange surface is thus oriented in such a way that it is naturally swept by the ascending flow of the air from the housing as it is heated in contact with the fins, this orientation being considered when the general axis of emergence of the light from the optical module is oriented approximately perpendicularly to the general axis of gravity. Such a general orientation of emergence of the light corresponds approximately to the orientation exhibited by the lighting and/or signaling device, once it is mounted on the vehicle for which it is intended. The fins are thus oriented along a general plane in the general axis of gravity.

Advantageously, the base exhibits a U-shaped profile comprising two lateral branches that are connected via a central branch, and the optical module is situated at the level of the central branch.

The above characterizing features and other characterizing features of the present invention will be appreciated more clearly with respect to the following description of modes of implementation of the invention with reference to the figures in the accompanying drawings, in which:

BRIEF DESCRIPTION OF THE ACCOMPANYING DRAWINGS

These and other objects and advantages of the invention will be apparent from the following description, the accompanying drawings and the appended claims FIG. 1 is a schematic view in elevation illustrating a lighting and/or signaling device according to an embodiment of the present invention from the front;

DETAILED DESCRIPTION OF THE PREFERRED EMBODIMENTS

Figure 1:
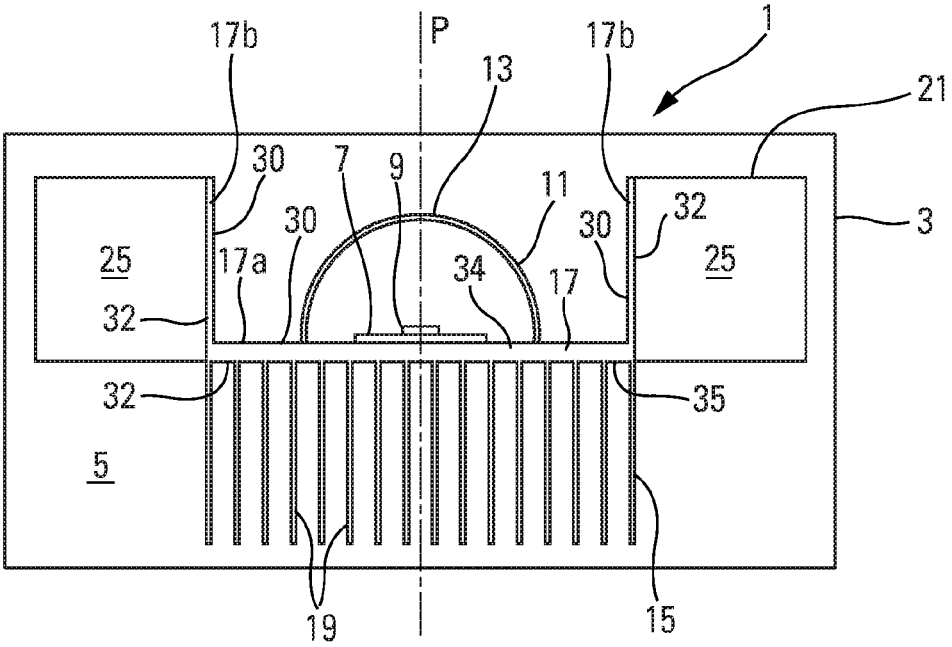

Identical references are used below to designate identical or similar elements.

As illustrated in FIGS. 1 to 4, the invention relates to a lighting and/or signaling device 1 for a motor vehicle. It comprises a housing 3 closed by an outer transparent closing lens 5, as illustrated in a highly schematic manner.

The housing 3 in this case accommodates an optical module 7 for the emission of at least one global light beam via the outer transparent closing lens 5. This optical module 7 includes, for example, a light source 9 constituted by one or a plurality of LEDs. An optical system 11 is associated with the optical module 7. It is intended to modify at least one of the parameters of the light generated by the light source 9, such as its average reflection and/or its direction. In the example depicted, the optical system 11 comprises a reflector 13, which concentrates the light emitted by the light source 9 into a light beam in the direction of the outer transparent closing lens 5, facing towards the observer in FIG. 1.

The invention also relates to a cooling member 15 for such a lighting and/or signaling device 1. This cooling member 15 is intended to dissipate the heat generated by the light source 9 during operation. It comprises a base 17, on which the optical module 7 is mounted. In the illustrative embodiment shown here, the optical module 7 is supported by a middle section, central plate, floor or central branch 17*a* of the base 17. The base 17 comprises two large flat parallel faces 30, 32 linked by a wafer 34, in particular large plane faces, which are parallel to one another in pairs. This base 17 is relatively solid, for example being molded in metal of the aluminum type or in an alloy of aluminum.

The base 17 comprises, for example, the middle section 17*a* and at least one lateral fin, lateral branch, side plate or plate 17*b*, being two in number in this case. The middle section 17*a* and the at least one lateral fin 17*b* are flat, for example. In other words, they each comprise two large flat parallel faces 30, 32 that are connected together by the wafer 34. The at least one lateral fin 17*b* extend, for example, from the middle section 17*a* of the base 17, in particular by being produced from the material of the latter. The base 17 can thus be obtained by molding and/or by extrusion. It exhibits a U-shaped profile in this case, the at least one lateral fin 17*b* defining the lateral branches of the U and the middle section 17*a* defining its central branch. In other words, the at least one lateral fin 17*b* in this case are turned at a right angle to the central plate 17*a* of the base 17.

The cooling member 15 in addition comprises a heat dissipater or heat dissipating device 21 in thermal conduction connection with the base 17. The heat dissipating device 21 comprises a plurality of cooling fins 19, 23, which are arranged with a space for the convection of the air between them.

In particular, the heat dissipater 21 comprises a first series of fins 19 associated with the central plate 17*a* of the base 17, in particular being produced from the material of the central plate 17*a*, and advantageously being extruded. The fins 19 of the first series of fins are parallel to each other and parallel to the at least one lateral fin 17*b* of the base 17.

The heat dissipater 21 in addition includes two other series 25 of fins 23, in this case identical, mounted to either side of the middle section 17*a*, facing towards the reflector 13, these sides being constituted by plates 17*b* forming the fins 23 of the base 17. The fins 23 in this case are parallel to the plate 17*a*. The series includes a median plane of symmetry P.

These series 25, for example, are brazed, welded and/or glued by means of a thermally conductive glue to the side plates 17*b*. They occupy a parallelepipedic rectangular volume, to either side of the side plates 17*b* of the base. They are thus perfectly suitable to be integrated in the space available in the housing 3, as can be appreciated in FIG. 1. In this configuration, the heat dissipating device 21 participates in the action of the cooling member 15 and does not compromise either the optical module 7 or the reflection of the light beam emerging from the reflector 13 of the optical system 11.

Figure 2:
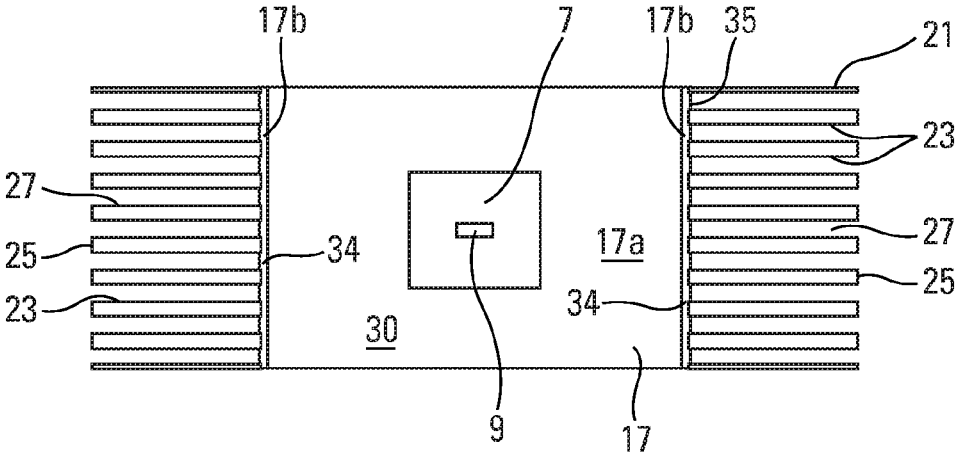
FIG. 2 is a schematic view from above showing the components of the lighting and/or signaling device as depicted in FIG. 1.

The fins 23 of the one or more other series of fins are produced from thin aluminum sheet, for example with a thickness of 0.8 millimeter, folded continuously on each of the series 25 in order to form air convection channels 27, as can be seen in FIG. 2. These air convection channels 27 are of substantially U-shaped section and are alternately open and closed, two by two, on their side opposite the at least one lateral fin 17*b*. The plane of the fins 23 or the axis of the air convection channels 27 is oriented substantially parallel to the gravity vector. The distance between the planes of the fins 23 in the air convection channels 27 is provided in order to ensure natural ascending convection of the air, for example being comprised between 4 and 6 millimeters.

It should be noted that, having regard for the given form of the base 17, the fins 19 associated with the middle section 17*a* of the base 17 and the fins 23 associated with each of the at least one lateral fin 17*b* exhibit junction areas 35 with the base 17 that are situated in different planes.

The fins 19 of the first series of fins and the fins 23 of the one or more other series in this way constitute a general surface for thermal exchange with the ambient air in order to obtain cooling of the optical module 7 and thus of the light source 9 which is allocated to them.

The cooling air flow is naturally generated by the ascending movement of the air as it is heated in contact with the fins 19, 23 constituting the heat exchange surface for cooling, the temperature of this heat exchange surface being greater than that of the surrounding air. The available space in the housing 3 beneath the cooling member 15 and beneath each of the series 25 of the heat dissipater 21 is configured in such a way as to be sufficient to permit the air to circulate in the fins 19, 23.

With reference to FIG. 2, it will be appreciated that the number of fins 23 of the one or more series 25 of fins 23 over a given length, transversal to the planes, is relatively dense, and is more dense than the corresponding number of fins 19 of the first series of fins, which provides the cooling member 15 with an improved thermal exchange efficiency for cooling of the optical module 7. The mass of the heat dissipater 21 is maintained at a relatively low level by the use of the one or more other series 25 of fins 23, which may be intentionally finer than the fins 19 of the first series of fins. It should also be noted that the use of two technologies in order to define the fins 19, 23, such as a molding or extrusion technology for the fins 19 of the middle section 17*a* and a technology involving folded fins and/or fins that are attached by brazing, gluing and/or welding, offers the possibility of making a cooling member available at limited cost. The choice of a connection area that is present in the area of a single large face of the base 17 similarly makes it possible to obtain the cooling member 15 while at the same time allowing a good exchange between the fins 19, 23 and the base 17.

Figure 3:
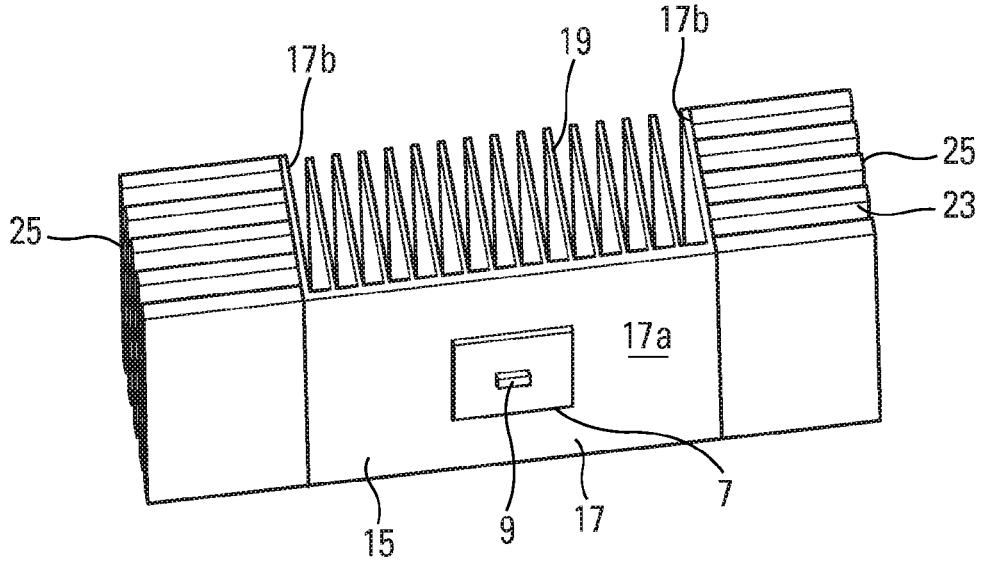
FIG. 3 is a schematic view in perspective illustrating a cooling member, according to a variant embodiment, substantially along the general axis of emergence of the light emitted by the optical module equipping the member.
Figure 4:
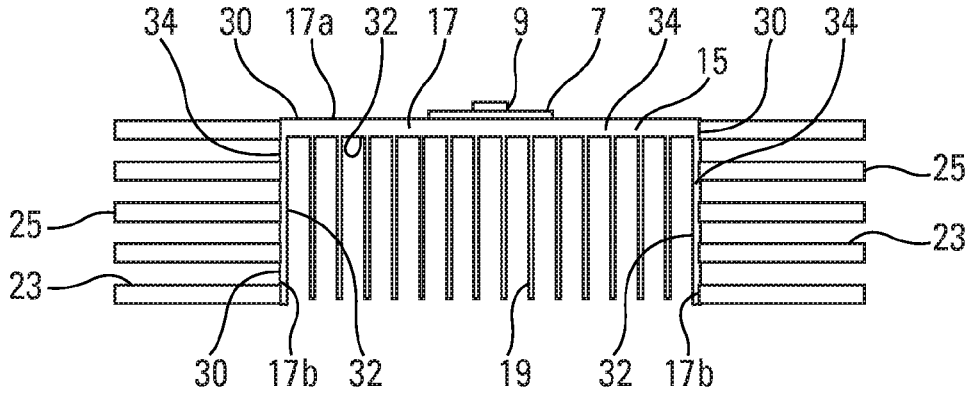
FIG. 4 is a schematic view from above of the cooling member and of the optical module in FIG. 3.

A variant embodiment is depicted in FIGS. 3 and 4. This variant differs from the preceding embodiment by the implantation of the two series 25 of fins 23 on the base 17. These series 25, which are identical to those of the preceding embodiment, are in fact arranged as an extension of the fins 19 of the first series of fins. The at least one lateral fin 17*b* of the base 17 are directed downwards in this case.

Thus, in the embodiment depicted in FIGS. 1 and 2, the optical module 7 is situated between the at least one lateral fin 17*b*, whereas, in the embodiment depicted in FIGS. 3 and 4, it is the fins 19 of the first series of fins that are situated between the at least one lateral fin 17*b* on this occasion.

This being the case, the first series of fins 19 and the one or more other series 25 of fins 23 may define channels that are oriented in a different manner, as shown in FIGS. 1 and 2, or in parallel, as shown in FIGS. 3 and 4.

It should be noted that the shape of the fins 19, 23 may be adapted to the shape of the housing 3 in order to provide a minimum space for the circulation of the air between the extremities of the fins 19, 23 and the wall of the housing 3. The fins 19, 23 may exhibit smooth and flat walls, for example, in order to facilitate the convection.

These fins 19, 23 could still have a curved profile on a part of their section, for example sinusoidal, in a substantially vertical axis of development, which further increases the heat exchange surface relative to a straight profile.

The invention thus affords a possibility of optimizing the cooling of a light source, in particular of the electroluminescent diode type, in the lighting and signaling devices for motor vehicles.

While the system, apparatus, process and method herein described constitute preferred embodiments of this invention, it is to be understood that the invention is not limited to this precise system, apparatus, process and method, and that changes may be made therein without departing from the scope of the invention which is defined in the appended claims.

What is claimed is:

1. A cooling member for at least one of a lighting device or a signaling device for a motor vehicle, said cooling member comprising a base configured to support a light source of said at least one of said lighting device or said signaling device, and at least one heat dissipating device in thermal conduction connection with said base, said heat dissipating device comprising a plurality of heat dissipation fins, said base having large faces linked by and having at least a portion extending in a first direction from each end of a central plate, said plurality of heat dissipation fins having a first plurality of heat dissipation fins associated with said central plate and extending at least partially in a second direction that generally opposes said first direction and monolithically produced with the same material as said central plate, said plurality of heat dissipation fins further comprising a second plurality of heat dissipation fins that are attached to either side of said central plate on at least one of said large faces, each of said second plurality of heat dissipation fins having a junction area extending linearly in a straight line on at least one of said large faces, wherein said central plate lies in a first plane, each of said first plurality of heat dissipation fins lie in a second plane that is generally perpendicular to said first plane and each of said second plurality of heat dissipation fins lie in a third plane that is generally perpendicular to said first and second planes.

2. The cooling member as claimed in claim 1, in which said base comprises a floor and at least one lateral fin.

3. The cooling member as claimed in claim 2, in which at least one of either said first plurality of heat dissipation fins extends from said floor or said second plurality of heat dissipation fins extends from said at least one lateral fin.

4. The cooling member as claimed in claim 3, in which at least one of said first plurality of heat dissipation fins is at least one of extruded or molded with said base.

5. The cooling member as claimed in claim 3, in which at least one of said second plurality of heat dissipation fins is attached to said base by at least one of a braze, a weld or an adhesive.

6. The cooling member as claimed in claim 1, in which fins of at least one of said second plurality of heat dissipation fins attached to said base are attached individually to said base.

7. The cooling member as claimed in claim 1, in which at least certain fins of said second plurality of heat dissipation fins attached to said base are attached in pairs to said base in the form of a folded sheet.

8. The cooling member as claimed in claim 1, in which at least certain fins of at least one of said second plurality of heat dissipation fins attached to said base are attached to said base in the form of a sheet folded like an accordion.

9. The cooling member as claimed in claim 8, in which said sheet is folded continuously as a series of adjacent air convection channels.

10. The cooling member as claimed in claim 1, in which grooves are provided in said base to receive said second plurality of heat dissipation fins.

11. The cooling member as claimed in claim 1, in which a thickness of each of said first and second plurality of heat dissipation fins is between 0.8 and 1 millimeters.

12. The cooling member as claimed in claim 1, in which a distance between adjacent ones of said first or second plurality of heat dissipation fins is between 4 and 6 millimeters.

13. A device for a motor vehicle comprising a cooling member as claimed in claim 1, said device being at least one of a lighting device or a signaling device.

14. The device as claimed in claim 13, comprising a housing closed by an outer lens intended to be traversed by one or a plurality of light beams, said housing accommodating at least one optical module comprising said light source and an optical system capable of modifying at least one parameter of the light generated by said light source for the emission of the one or more light beams by said device, said heat dissipating device being mounted in the available volume of said housing around said at least one optical module or said optical system .

15. The device as claimed in claim 14, in which said base exhibits a U-shaped profile and said optical module is situated at the level of said central branch.

16. The cooling member as claimed in claim 4, in which at least one of said second plurality of said heat dissipation fins is attached to said base by at least one of a braze, a weld or an adhesive.

17. The cooling member as claimed in claim 6, in which grooves are provided in said base to receive said second plurality of heat dissipation fins.

18. The cooling member as claimed in claim 2, in which thickness of each of said first and second plurality of heat dissipation fins is between 0.8 and 1 millimeters.

19. The cooling member as claimed in claim 2, in which a distance between adjacent ones of said first or second plurality of heat dissipation fins is between 4 and 6 millimeters.

20. A device for a motor vehicle comprising a cooling member as claimed in claim 2, wherein said device is at least one of a lighting device or a signaling device.

* * * * *